United States Patent [19]

Leiby

[11] Patent Number: 4,667,398

[45] Date of Patent: May 26, 1987

[54] IMPROVED APPLICATOR TOOLING FOR CERTAIN ELECTRICAL CONNECTORS

[75] Inventor: Douglas J. Leiby, Enola, Pa.

[73] Assignee: AMP Incorporated, Harrisburg, Pa.

[21] Appl. No.: 867,009

[22] Filed: May 20, 1986

Related U.S. Application Data

[63] Continuation of Ser. No. 693,076, Jan. 22, 1985.

[51] Int. Cl.[4] ..... H01R 43/04

[52] U.S. Cl. ..... 29/749; 29/566.3; 29/566.4; 29/751; 29/753

[58] Field of Search ..... 29/749, 751–754, 29/566.3, 566.4

[56] References Cited

U.S. PATENT DOCUMENTS

| | | | |
|---|---|---|---|
| 3,494,171 | 2/1970 | Rapp | 29/751 X |
| 3,952,392 | 4/1976 | Nijman et al. | 29/749 X |
| 4,178,675 | 12/1979 | Phillips | 29/753 X |
| 4,227,299 | 10/1980 | Kuehling | 29/751 |
| 4,428,636 | 1/1984 | Kam et al. | 339/17 |

FOREIGN PATENT DOCUMENTS 956072 4/1964 United Kingdom .

OTHER PUBLICATIONS

AMP Incorporated application specification No. 114–2086 (1983).

AMP Incorporated instruction sheet IS 6825, "AMP Certi-Lok Hand Crimping Tool", 58097–1 (1983).

AMP Incorporated instruction sheet IS 6826, "AMP Crimping Die Assemblies", (1983).

*Primary Examiner*—Carl E. Hall

*Attorney, Agent, or Firm*—Anton P. Ness

[57] ABSTRACT

Tooling to apply an SDL connector to a cable containing a plurality of conductors contains at least a contact-engaging die surface to apply contacts to said conductors. The die surface is on a crimping plate which is secured to the tooling against a main body member and is incrementally movable vertically by the user of the tooling through a range of adjustment positions to adjust the height of the die surface which results in an adjusted height of the contacts after application. The crimping plate is movable by a plate-moving means such as a wedge member having a slightly sloping bearing surface where the wedge member is moved horizontally atop the main body member by an adjustment screw, for instance. The tooling can be secured in a handtool, or a pneumatic bench machine, or a semiautomatic applicator apparatus as desired.

23 Claims, 9 Drawing Figures

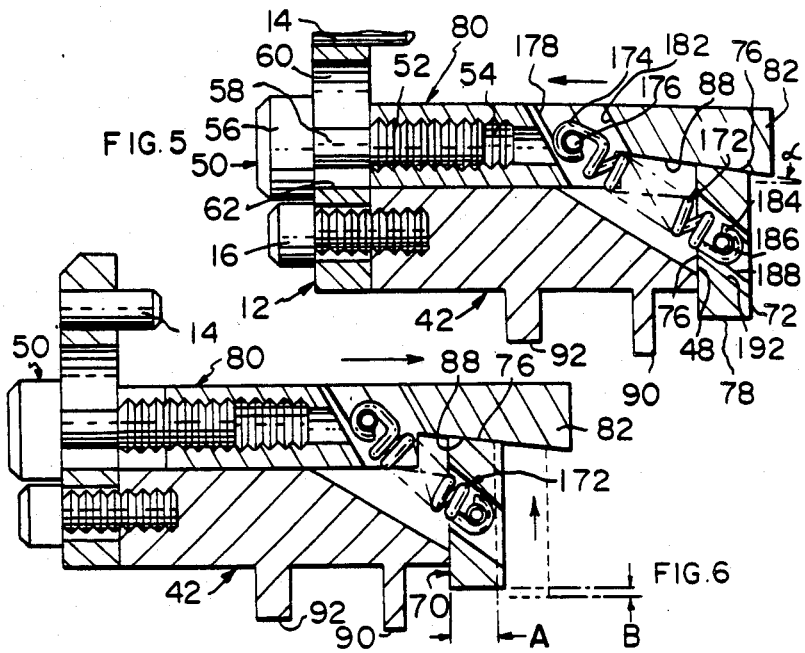
FIG. 5
FIG. 6
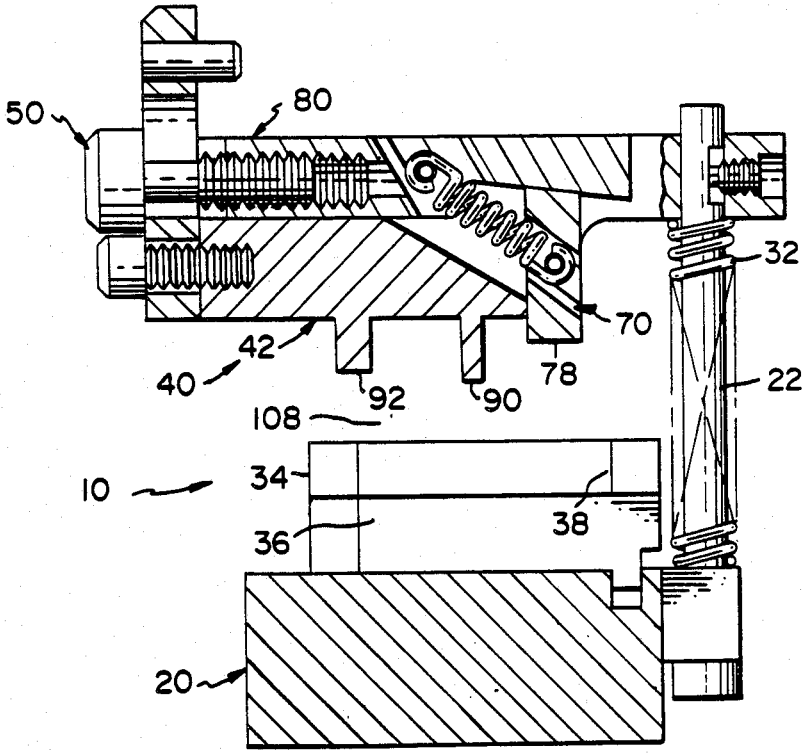
FIG. 7

IMPROVED APPLICATOR TOOLING FOR CERTAIN ELECTRICAL CONNECTORS

This application is a continuation of application Ser. No. 693,076 filed Jan. 22, 1985.

FIELD OF THE INVENTION

This invention relates to the field of tools and more particularly to applicator tools and apparatus for electrical connectors.

BACKGROUND OF THE INVENTION

Various applicator tools are known for applying contact terminals onto electrical conductors. Certain hand-held tools are also known which are especially useful for applying particular types of electrical connectors to several conductors simultaneously. One such connector for terminating round or flat shielded cable is a shielded data link, or SDL, connector sold by AMP Incorporated; an applicator tool therefor is sold by the same company under the product identification AMP CERTI-LOK (trademark) Hand Crimping Tool 58097-1, with a crimping die assembly for use therewith under product identification 58092-1. Such crimping die assemblies comprise a base plate and an upper die, the upper die having a contact applicater and two strain relief crimpers, one of which crimps the connector onto the insulation of the plurality of conductors within the cable, and the other crimps the connector onto the cable shield and outer jacket to form the primary strain relief.

The contact applicator of the prior art crimping tool is an integral part of the upper die, consisting of a die surface extending in a plane which is axially normal to the conductors of the shielded cable which are arranged parallel in a plane at least at a forward end of the cable. This die surface is used to push a plurality of parallel contacts simultaneously deeper within contact-retaining guide slots of the connector to pierce insulation around associated conductors with which the contacts are parallel and establish an electrically conductive engagement therewith, with upper surfaces of the contacts accessible by corresponding contact surfaces of a mating connector receptacle of an electronic apparatus to which the SDL connector-terminated cable is to be connected. Such a shielded data link connector and contacts therefor are disclosed, for example, in AMP Application Specification No. 114-2086 incorporated herein by reference, and also U.S. Pat. No. 4,428,636.

It is known that during such application crimping, the contacts are pushed by the contact-engaging die surface a fixed depth into the conductor insulation but upon retraction of the die surface are pushed back by the insulation a slight distance, believed to result mostly from the resilience or the durometer of the insulation. It is also known that differences in the slight distance which the contacts are pushed back can adversely affect the performance of the connector when it is connected to a mating receptacle by virtue of the contacts being engaged by mating contact surfaces of the mating receptacle; for this reason, in such an applied SDL connector strict tolerance limits are set for the contact height which is the height of the upper contact surface with respect to the bottom surface of the connector.

Because the durometer of the conductor insulation may change, or dimensions of the conductor insulation may change even within a single manufactured length of such rounded or flat shielded cable, it is highly desirable for the personnel applying the SDL connector to a preselected length of such cable to be able to make slight but important corresponding on-line adjustments in the height of the contact-engaging die surface within a crimping die assembly in a handtool without replacing the die assembly with another assembly having a slightly different fixed contact-engaging die surface height.

It is also desirable to have a crimping die assembly with such an operator-adjustable height of contact-engaging die surface, for use with semiautomatic application apparatus, in addition to hand-held manually-operated applicator tools, and also pneumatic bench applicator machines.

SUMMARY OF THE INVENTION

The crimping die assembly of the present invention has a contact-engaging die which is separate from but secured to the main upper die of the assembly to form an upper die subassembly, and the crimping height of the die surface is operator-adjustable while the assembly is secured in the crimping handtool, or semiautomatic apparatus. The upper die subassembly comprises a main upper tooling body member having integral strain relief crimping die surfaces, a vertical plate fixedly fastened forwardly of the main body member, a wedge member movably and adjustably secured by an adjustment screw to the vertical plate atop the main body member and horizontally slidable thereon, and a crimping plate having the contact-engaging surface thereon.

The die surface of the contact crimping plate is disposed on the bottom of the crimping plate which is secured vertically to the rear of the upper die subassembly. The top of the crimping plate is precisely beveled at a slight preselected angle to the horizontal to be slidably disposed against a cooperating angled bearing surface of the wedge member. A diagonally oriented tension spring secures the crimping plate to the wedge, being secured to the wedge at a point distant from the bearing area and forwardly thereof, and being secured to the crimping plate at a point approximately centrally vertically therealong. With such an arrangement, the tension spring applies spring force on a substantial diagonal, and such spring force thus has a horizontal force component and a vertical force componet. The crimping plate also bears against a rearward vertical bearing surface of the main body member and is movable vertically therealong, held thereagainst by the diagonal tension spring.

The vertical force component of the tension applied by the diagonal tension spring holds the crimping plate's beveled top surface against the cooperating angled bearing surface of the wedge, while the crimping plate is held in a vertical orientation by being disposed in a vertical recess along the rearward surface of the main body member. As the wedge is moved forwardly by the adjustment screw through a range of positions with respect to the main body, the main body holds the crimping plate upright and stationary with respect to the horizontal, which action urges the wedge's cooperating bearing surface against the beveled top surface of the crimping plate and moving the crimping plate downward, making the desired vertical adjustment of the crimping plate with respect to the main body through a range of adjustment positions. Correspondingly, as the wedge is moved rearwardly, the diagonal tension spring urges the crimping plate upwardly a desired increment as the beveled top surface of the crimping plate moves along the wedge's cooperating bearing surface. With such an adjustability there is no requirement (otherwise needed in order to minimize crimped SDL connectors being out of specification and therefore unusable) for large inventory of crimping die assemblies having integral contact-engaging die surfaces varying only in the crimp height of the contact-engaging die surfaces.

BRIEF DESCRIPTION OF THE DRAWINGS

FIGS. 5 and 6 are illustrations of the contact applicator die of the invention, being adjusted in longitudinal section.

FIGS. 7 through 9 are longitudinal section views of the applying die assembly illustrating the applying of an SDL connector.

DETAILED DESCRIPTION OF THE PREFERRED EMBODIMENT

Figure 2:
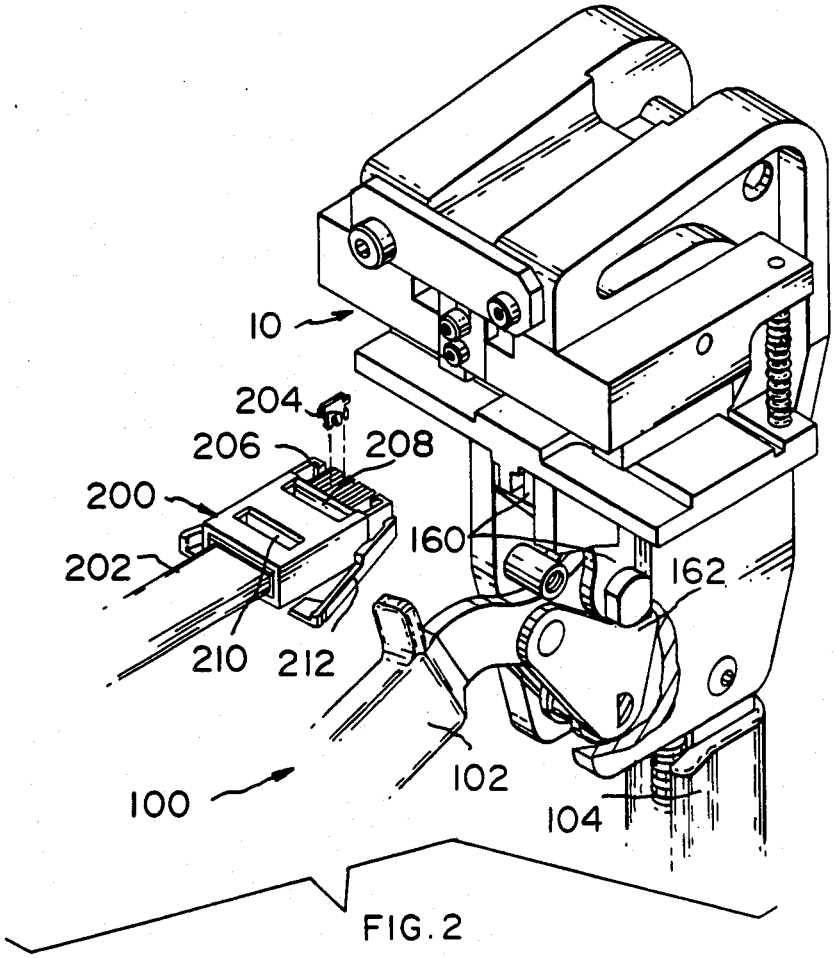
FIG. 2 is a perspective view of the applicator head portion of the tool of FIG. 1 in an open position, with an SDL connector to be inserted therein.
Figure 1:
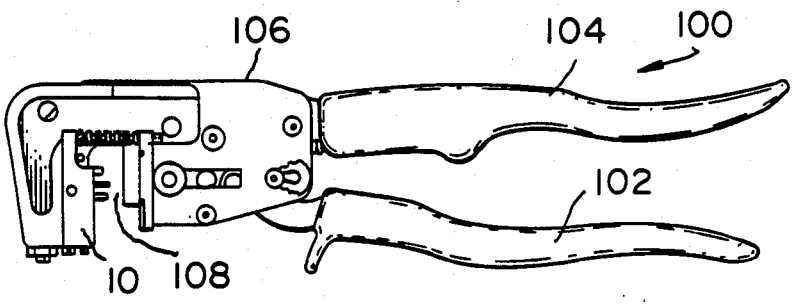
FIG. 1 is a side view of an applicator handtool having a crimping die assembly therein.

In FIG. 1 is shown a handtool 100 for applying a shielded data link (SDL) connector onto a shielded ribbon cable. Tool 100 has forward and rearward handles 102, 104 respectively and an applicator head portion 106 to which the handles are affixed. Applicator head portion 106 receives a connector (which is shown in FIG. 2) in crimping recess 108 between an upper connector-engaging surface means and a lower connector-engaging surface means of crimping die assembly 10 which is removably securable in applicator head portion 106. In the embodiment shown, the upper surface means is the die means, and two strain relief crimps and a contact crimp are applied to the connector by respective crimping surfaces on the die means of the crimping die assembly. Forward handle 102 is shown in its closed position.

FIG. 2 shows the applicator head portion 106 of tool 100 with crimping die assembly 10 assembled therein to receive an SDL connector 200 therein to be applied. Part of applicator head portion 106 is broken away to show platform 160 which is movable upward by way of camming action by camming surface 162 of forward handle 102 (shown here in its open position) in order to raise base plate 32 to push connector 200 inserted thereon upward against crimping surfaces on the die means for crimping, when forward handle 102 is manually closed by the user of tool 100.

Figure 9:
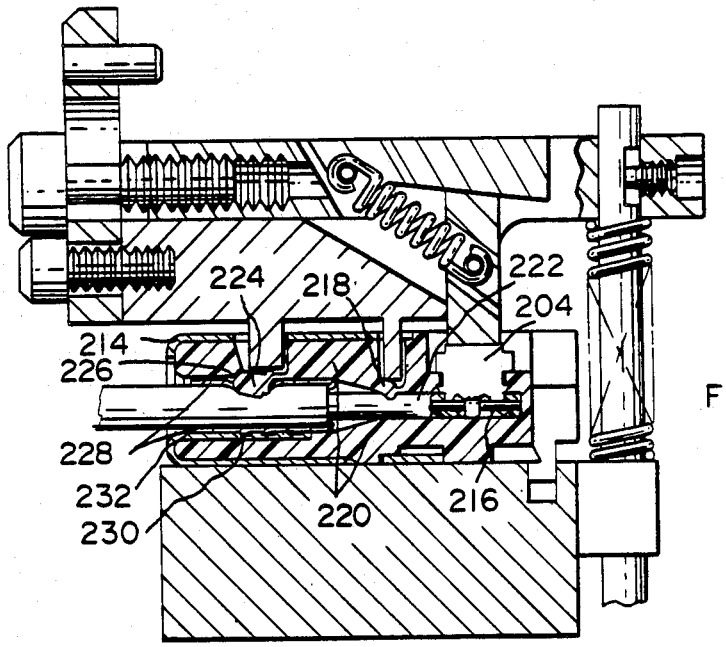

SDL connector 200 is disposed on the end of ribbon cable 202, which end (not shown) has had its outer insulation jacket stripped and its foil shield and drain wires folded back along the jacketed portion of the cable to expose insulated conductors in the forward portion of the connector. Individual contacts 204 are loosely disposed in slots 206 and extend upward to be engaged by the contact-engaging surface of a contact crimper on the die means to be pushed thereby into the insulation of a respective conductor and into electrical engagement with the conductor, as seen in FIG. 9. Rearwardly from contacts 204 are slots 208, 210 in both the metallic outer shell and the inner plastic body of connector 200 into which secondary and primary strain relief crimping surfaces respectively of the upper die will enter to deform features of the inner body of connector 200 into strain relieving engagement with the conductor insulation near contacts 204, and with the cable outer jacket 203 near the rear of the connector, as better seen in FIG. 9. Latching arms 212,in FIG. 1, extend laterally of connector 200 for use in its mating with the desired electronic apparatus.

Figure 3:
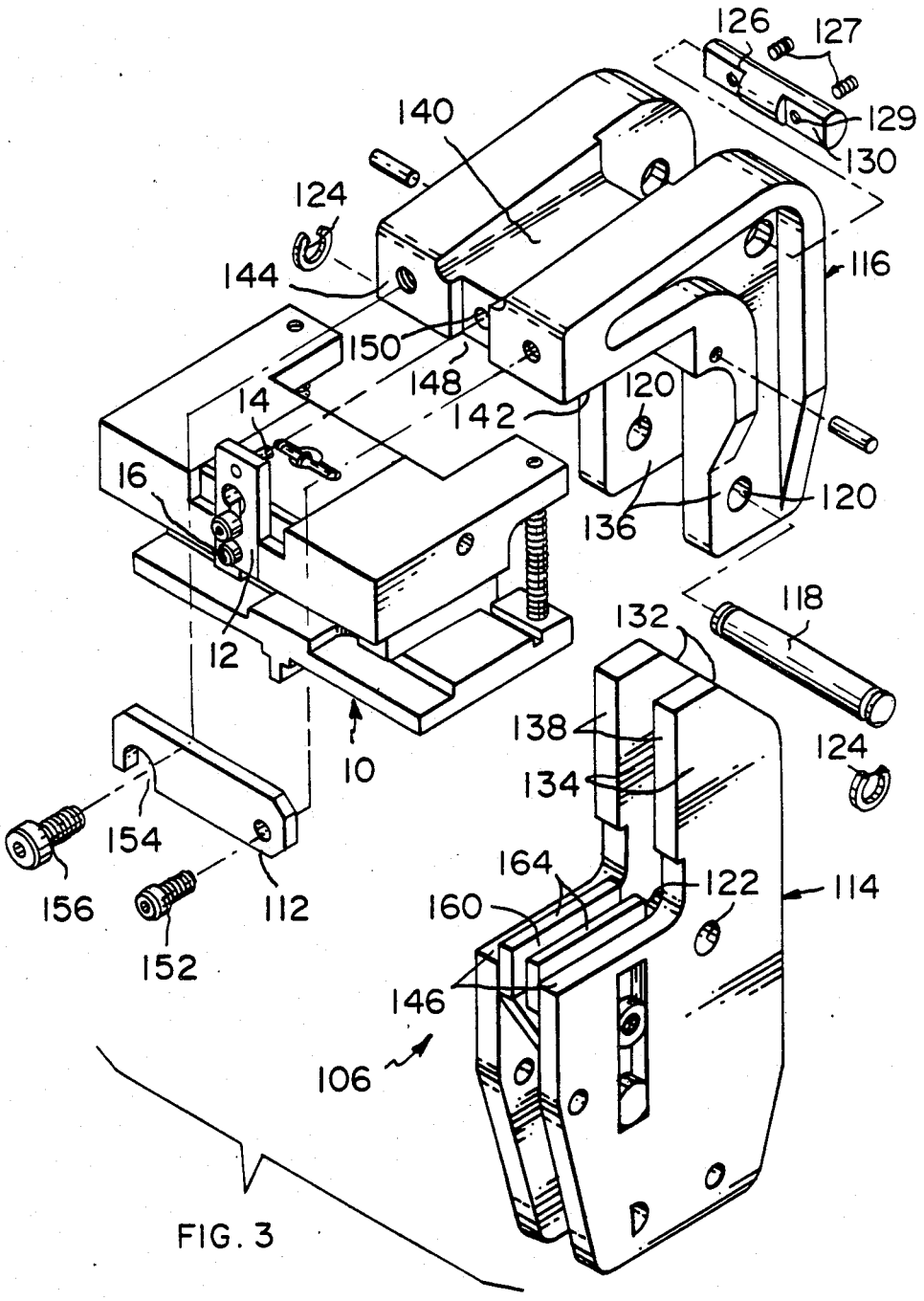
FIG. 3 is an exploded perspective view of the applicator head portion of FIG. 2, with the crimping die assembly exploded therefrom.

FIG. 3 shows applicator head portion 106 of tool 100 with crimping die assembly 10 securable therein by means of latching bar 112. Applicator head portion 106 has a body portion 114 and a holder portion 116 secured thereto by pin 118 extending transversely of tool 100 through opposing pin-receiving holes 120 of holder portion 116 and corresponding opposing pin-receiving holes 122 of body portion 114, with pin 118 secured therein by retaining rings 124 disposed on ends of pin 118 extending outward from holes 120 of holder portion 116.

At the top rear of holder portion 116 is holder clamp 126 secured in opposing clamp-receiving holes 128 transverse of holder portion 116. Holder clamp 126 has chordal surface portions 130 which engage corresponding rearwardly facing angled surfaces 132 at the top of arms 134 which project upwardly as part of body portion 114 and are disposed between downwardly extending arms 136 of holder portion 116. Screws 127 are threadedly inserted into holes 129 through holder clamp 126 to engage angled surfaces 132 and be tightened thereagainst; this arrangement with holder clamp 126 disposed rearwardly of the top of arms 134 of body portion 114 essentially prevents forward movement of holder portion 116 with respect to body portion 114. Forwardly facing surface portions 138 at the top of arms 134 engage the rearwardly facing surface (not shown) of center section 140 of holder portion 116 to prevent rearward movement of holder portion 116 with respect to body portion 114.

With holder portion 116 assembled to body portion 114, crimping die assembly 10 is insertable between lower surface 142 of forward section 144 of holder portion 116 and spaced horizontal surfaces 146 of body portion 114 of tool 100. Between horizontal surfaces 146 is platform 160 whose top surfaces 164 are recessed below surfaces 146 when forward handle 102 is in its open position as in FIG. 2, and which rise (when platform 160 is cammed upward) above surfaces 146 when handle 102 is moved into its closed position as in FIGS. 1 and 3. Base plate 20 of crimping die assembly 10 will rest on surfaces 146 when handle 102 is in its open position, and will be raised upward by surfaces 164 of platform 160 after a connector 200 has been inserted and handle 102 is moved by the user of the tool into its closed position to crimp the connector.

Crimping die assembly 10 has a vertical plate section 12 located centrally along the forward face of the die means of the assembly, which extends upwardly from the assembly into a plate recess 148 along the forwardly facing surface of forward section 144 of holder portion 116. A guide pin 14 such as a roll pin extends rearwardly from vertical plate section 12 to be received in a corresponding guide hole 150 in plate recess 148. Latching bar 112 is secured to the forward surface of forward section 144 of holder portion 116. When crimping die assembly 10 is positioned in applicator head portion 106 of tool 100 with vertical plate section 12 in plate recess 148, latching bar 112 is pivoted about securing screw 152 to be disposed forwardly of the top of vertical plate section 12 such that recess 154 of latching bar 112 engages a shank portion of screw member 156 received in a threaded hole also extending into forward section 144. Screws 152 and 156 are then tightened to secure latching bar 112 and thus vertical plate section 12 against forward section 144 of holder portion 116, thus securing crimping die assembly 10 firmly in applicator head portion 106 of tool 100, as shown in FIG. 2.

Figure 4:
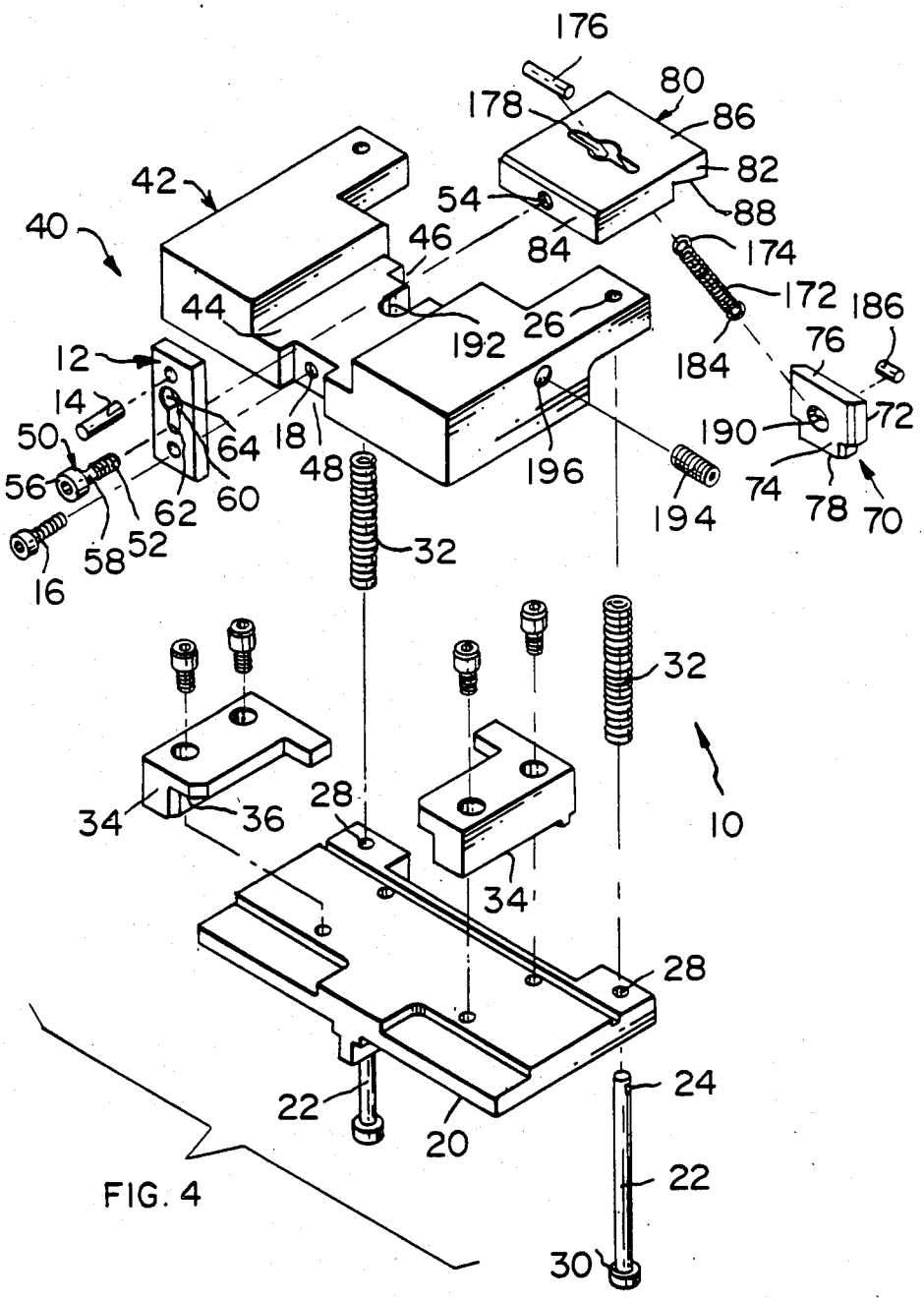
FIG. 4 is an exploded view of the crimping die assembly of the present invention.

As shown in FIG. 4, crimping die assembly 10 comprises a die subassembly 40 and a base plate 20 which constitutes the lower connector-engaging surface means and is secured thereto which is movable vertically with respect thereto along a pair of vertical guide rods 22, which are disposed in the rearward portion of crimping die assembly 10. The top ends 24 of guide rods 22 are firmly secured in holes 26 in die subassembly 40 either by locking screws (as shown in FIG. 7) or by being threaded into holes 26 which would be correspondingly threaded, while lower unthreaded sections of the guide rods extend through holes 28 in base plate 20. Enlarged ends 30 of guide rods 22 retain base plate 20 thereon, and compression springs 32 urge base plate 20 into an open position spaced from die subassembly 40 and against enlarged ends 30, while allowing base plate 20 to be urged toward die subassembly 40 by platform 160, FIG. 3, during crimping of a connector.

Figure 8:
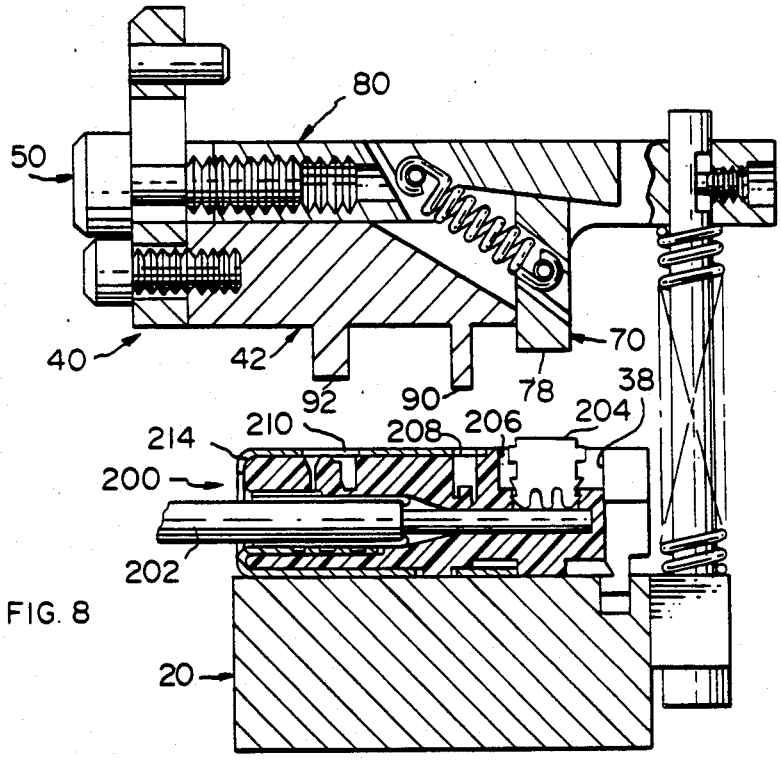

Base plate 20 has connector guides 34 secured to its upper surface. Connector guides 34 have sidewalls 36 profiled to guidingly receive and hold SDL connector 200 therein against relative vertical movement, such as by engaging latching arms 212 or a ledge feature (not shown), and endwall portions 38 to stop and locate connector 200 upon insertion, as shown in FIGS. 8 and 9.

Referring again to FIG. 4, die subassembly 40 comprises a main body member 42 having a large channel 44 in the top surface thereof and a rearward vertical recess 46 centrally of the rearward surface thereof. A plate-moving means such as wedge member 80 is disposed in large channel 44, and a crimping plate 70 is secured to and extending downward from rearward portion 82 of wedge member 80 within vertical recess 46 of main body member 42. vertical plate section 12 is secured in a forward vertical recess 48 of main body member 42 such as by a screw 16 extending into a threaded hole 18. Wedge member 80 is horizontally movable in large channel 44 along a forward-rearward axis, by manual or mechanical adjustment, of an adjustment member such as adjustment screw 50 (or other similar operator-accessible adjustment means) secured in vertical plate section 12 with threaded shank 52 extending rearwardly and received by threaded hole 54 in forward surface 84 of wedge member 80. As head 56 of adjustment screw 50 forwardly of vertical plate section 12 is rotated by the user of the tool such as by use of an Allen wrench, wedge member 80 is moved incrementally along large channel 44. Adjustment screw 50 is freely rotatable with respect to vertical plate section 12 and may have a narrow neck 58 disposed in a narrow lower portion 62 of "keyhole" slot 60 after threaded shank 52 has first been inserted in a substantially larger upper portion 64 of slot 60 above portion 62, with threaded shank 52 having an outer diameter larger than narrow lower portion 62 of slot 60, following which adjustment screw 50 is lowered in "keyhole" slot 60.

With reference to FIGS. 4 and 5, crimping plate 70 is secured to wedge member 80 by a securing means, preferably by a tension spring 172, one end 174 of which is secured to wedge member 80 such as by pin 176 extending horizontally through an end coil of spring 172 and disposed in a transverse pin recess 178 in the top surface 86 of wedge member 80 with spring 172 extending through a passageway 182 in wedge member 80. The other end 184 of spring 172 is similarly secured to crimping plate 70 by a pin 186 extending through an end coil, with pin 186 disposed in a transverse pin recess 188 in the rearward surface 72 of crimping plate 70 and spring 172 extending through a passageway 190 in crimping plate 70.

Tension spring 172 is preferably disposed in a diagonal orientation within diagonal channel 192 of main body member 42 with end 174 of spring 172 secured approximately in the middle of wedge member 80 and end 184 secured approximately in the middle of crimping plate 70. The tension of spring 172 is such as to hold forward vertical surface 74 of crimping plate 70 against vertical bearing surface 48 of main body member 40 by means of a horizontal force component, and to hold the contact-remote upper beveled surface 76 of crimping plate 70 against bearing surface 88 of wedge member 80 by means of a vertical force component.

Bearing surface 88 of wedge member 80 is at a slight angle $\alpha$ from the horizontal and declining from front to rear of rearward portion 82; and upper surface 76 of crimping plate 70 is correspondingly beveled to substantially the same angle $\alpha$ from the horizontal such that upon engagement of the two surfaces, crimping plate 70 is substantially vertical when wedge member 80 is horizontal. With this structure and arrangement, as best illustrated by FIGS. 5 and 6, as wedge member 80 is moved rearwardly by adjustment screw 50 in large channel 44 of main body member 42 through a range of positions crimping plate 70 will be urged relatively forwardly a representative distanee A with respect to wedge member 80 by reason of engagement with vertical bearing surface 48 of main body member 42 but remain horizontally stationary with respect to main body member 42.

Adjustment of wedge member 80 rearwardly along large channel 44 results in crimping plate 70 moving incrementally upwardly through a range of adjustment positions a representative distance B by the resulting camming action, as upper bearing surface 76 slides along bearing surface 88, urged by a horizontal force component of tension spring 172, resulting in an adjusted higher height of crimp surface 78 with respect to the SDL connector to be crimped. Similarly, as crimping plate 70 moves relatively rearwardly along bearing surface 88 of wedge member 80 when wedge member 80 is "pulled" forwardly along channel 44, crimping plate 70 will be urged incrementally downwardly through a range of adjustment positions by the resulting camming action of surface 88 against upper crimping plate bearing surface 76, and forward vertical surface 74 of crimping plate 70 will slide along vertical bearing surface 48 of main body member 42, resulting in an adjusted lower height of crimp surface 78 with respect to the SDL connector to be crimped by crimping plate 70. Upon completion of an adjustment, set screw 194 disposed within threaded hole 196 in one side of main body member 42 and transverse thereof, as shown in FIG. 4, will be tightened with an appropriate tool against the respective sidewall of wedge member 80 to hold it in its adjusted position; set screw 194 will then need to be correspondingly loosened when another adjustment needs to be made.

The relationship between horizontal distance A, vertical distance B, and angle ($\alpha$) is:

$$B=A \tan(\alpha)$$

When P represents the pitch of adjustment screw 50 and R represents the number of revolutions made with adjustment screw 50 during an adjustment step, distance A is figured as:

$$A=R \div P$$

Thus:

$$B=R \tan(\alpha) \div P$$

It is preferred that bearing surface 88 of wedge member 80 be at an angle of between about two degrees to about twelve degrees and, most preferably, an angle of seven degrees. Correspondingly, it is preferred that upper bearing surface 76 of crimping plate 70 be beveled to the same angle (in reverse) as that of wedge bearing surface 88 so that crimping plate 70 thereagainst is vertical when wedge member 80 is horizontal. It is preferred that adjustment screw 50 be a cap screw and be finely threaded with a pitch of about 40 threads per inch. With such a combination of preferred pitch and most preferred angle, an adjustability of crimping plate 70 is obtained of about 0.003 inch per one revolution of adjustment screw 50 and have a total vertical adjustment range of 0.015 inch.

The insertion and crimping of an SDL connector 200 is illustrated in FIGS. 7, 8 and 9. In FIG. 7, the crimping die assembly 10 is shown in its open position, with the remainder of tool 100 not shown. Crimping plate 70 with crimping surface 78 is shown closest to guide rods 22 in the rearward area of the crimping die assembly to be proximate the forwardmost end of a connector placed therein. Secondary strain relief crimping surface 90 is disposed approximately centrally of the connector and is the lowermost of the crimping surfaces, to extend most deeply into the connector through slot 208 of outer shell 214 (seen in FIG. 8). Primary strain relief crimping surface 92 is closest the forward end of the crimping die assembly to engage the rearward portion of the connector through slot 210 of outer shell 214. Insulated conductors 216 are held in shallow paired opposing grooves in top and bottom inside surfaces of connector 200, aligned with contacts 204 for electrical connection therewith.

FIG. 9 illustrates the engagement of contact crimping surface 78 of crimping plate 70 with a representative contact 204 pushed into mechanical and electrical engagement with a respective associated conductor 216 with which it has been aligned. Secondary strain relief crimping surface 90 urges a secondary strain relief section 218 of plastic body 220 of connector 200 into a deformed position extending into the conductor insulation 222 of conductor 216. Primary strain relief crimping surface 92 urges a primary strain relief section 224 of plastic body 220 into latched position under latching edge 226 "biting" into the outer jacket 203 of cable 202 which also serves to hold an upper folded-back portion of foil shield 228 (and drain wires, not shown) against jacket 203 on top, and a lower folded-back portion of foil shield 228 as well as the drain wires in electrical engagement against serrated surface 230 of a section 232 of metallic connector outer shell 214 which extends inwardly along cable 202 from the rearward end of the connector.

It is foreseeable that it may be desirable to use a biasing means other than tension spring 172 to urge crimping plate 70 forwardly against vertical main body bearing surface 48 and upwardly against wedge bearing surface 88 such as a compression spring contained in applicator head 106 or in the pneumatic or semiautomatic apparatus extending forwardly and upwardly therefrom to engage a projection on the rearward surface of crimping plate 70 when crimping die assembly 10 is secured therein. It may be desirable to have wedge bearing surface 88 slope upwardly to the rear and correspondingly to have upper bearing surface 76 of crimping plate 70 slope upwardly.

The crimping die assembly 10 containing the adjustable contact applicator of the present invention can be used with a pneumatic bench applicator machine to apply an SDL connector to cable, as well as with a handtool 100 as shown, with no modification believed necessary to the adjustable contact applicator, and little if any change to other aspects of the crimping die assembly.

The die subassembly 40 containing the adjustable contact applicator of the present invention can be used with semiautomatic applicator apparatus with only minor if any changes needed to the die subassembly. Such a subassembly can be removably secured in such apparatus, and adjustments to the height of the contact-engaging die surface made by the operator of the apparatus just as taught herein regarding the applicator handtool. Other operations performed by such an apparatus at different stations would include stripping the outer jacket of the cable, folding back the foil shield and drain wires and placing a connector on the prepared cable end prior to application using the contact applicator of the present invention. The operator of the apparatus would monitor the crimped SDL connector after application to determine if an adjustment of the contact applicator is necessary to bring the contact crimp height to within the strict tolerance limits required.

The adjustable contact applicator of the present invention may be usable with SDL connectors on round shielded cable, where a separate ferrule rearwaard of the connector is used to crimp rear extensions of appropriately shaped metal shell halves of the connector to the outer jacket of the round cable with other crimping tooling, the primary strain relief comprises two crimps, each laterally of the cable, rather than continuously across, and the individual insulated conductors at the forward end of the stripped round cable are held by alignment features of the connector parallel to each other in a single plane for contacts to be applied thereto by the contact applicator of the present invention. Also, unshielded cable may be used in certain cases.

It is foreseeable that the adjustable contact applicator may be utilized in tooling where strain relief crimping is not performed or is performed by separate tooling. The present invention is valuable where a plurality of contacts must be applied to respective insulated conductors, which may even be individual wires terminated to a single connector, which are held in alignment by the connector for application. Also, the contact applicator may be used for applying a connector having eight conductors, or sixteen, or twenty-four or the like as desired, with the transverse width of the crimping plate and the tooling varying accordingly.

Other various types of tooling may utilize the present invention, and modifications thereto may be made without departing from the spirit of the invention or the scope of the claims.

What is claimed is:

1. An improved applicator tooling for applying a connector to a preselected plurality of aligned insulated conductor ends, said connector having a like plurality of contacts disposed proximate said conductor ends and aligned theralong each to be applied into electrical and mechanical engagement with an associated one of said conductor ends, said contacts each having a contact surface parallel to said associated one of said conductor ends to be spaced therefrom a preselected distance after being applied, for electrical engagement with a mating contact surface of a receptacle connector, the tooling being of the type having a locating means and a securing means for said connector, an upper and a lower connector-engaging surface means wherebetween said connector is insertable for application, at least a contact applying means disposed on a die means on one of said upper and lower surface means, and a compression means for urging together said upper and lower surface means such that a connector inserted therebetween is applied thereby, the improvement comprising:

said contact applying means being a crimping plate secured by securing means to a main body member of said die means, said crimping plate having a contact-engaging surface to engage and push vertically and plurality of contacts into engagement with said conductor ends during an application step, and said crimping plate being controllably movable in the vertical direction with respect to said die means during an adjustment step while remaining secured to said main body member by said securing means; and said tooling further having an operator-accessible adjustment means for controllably moving said crimping plate through a range of adjustment positions in said adjustment step prior to said application of said connector to achieve a preselected distance from said contacts of said contact-engaging surface of said crimping plate, and further having stop means to secure said crimping plate against relative vertical movement with respect to said main body member during said application.

2. The improved tooling as set forth in claim 1 wherein said adjustment means includes a means for moving said crimping plate in a vertical direction during said adjustment step.

3. An improved applicator tooling for applying a connector to a preselected plurality of aligned insulated conductor ends, said connector having a like plurality of contacts disposed proximate said conductor ends and aligned therealong each to be applied into electrical and mechanical engagement with an associated one of said conductor ends, said contacts each having a contact surface parallel to said associated one of said conductor ends to be spaced therefrom a preselected distance after being applied, for electrical engagement with a mating contact surface of a receptable connector, the tooling being of the type having a location means and a securing means for said connector, an upper and a lower connector-engaging surface means wherebetween said connector is insertable for application, at least a contact applying means disposed on die means on one of said upper and lower surface means, and a compression means for urging together said upper and lower surface means such that a connector inserted therebetween is applied thereby, the improvement comprising:

said contact applying means being a crimping plate secured to a main body member of said die means, said crimping plate having a contact-engaging surface to engage and push said plurality of contacts into engagement with said conductor ends during applying, and said crimping plate being controllably movable in the vertical direction with respect to said die means;

said tooling further having means to secure said crimping plate against relative vertical movement with respect to said main body member during said application; and said tooling further having an operator-accessible adjustment means for controllably moving said crimping plate in an adjustment step prior to said application of said connector to achieve a preselected distance from said contacts of said contact-engaging surface of said crimping plate;

said adjustment means including a means for moving said crimping plate, secured thereagainst by securing means, in a vertical direction during said adjustment step; and said plate-moving means being disposed on a rearward portion of a wedge member controllably movable along a forward-rearward horizontal axis with respect to said die means during said adjustment step by an operator-accessible adjustment member.

4. The improved tooling as set forth in claim 3 wherein said wedge member is disposed in a large channel in a connector-remote surface of said main body member, said large channel being disposed along said forward-rearward horizontal axis and holding said wedge member in a forward-rearward orientation thereby.

5. The improved tooling as set forth in claim 3 wherein said plate-moving means is a bearing surface on said wedge member proximate said crimping plate and having a preselected angle from the horizontal, and said crimping plate has a bearing surface remote from said crimping surface thereof and disposed against said wedge bearing surface and having a preselected angle from the horizontal such that said crimping plate is vertical with respect to said die means.

6. The improved tooling as set forth in claim 5 wherein said wedge bearing surface declines towards the rearward end of said wedge member, and said bearing surface of said crimping plate correspondingly declines.

7. The improved tooling as set forth in claim 5 wherein said crimping plate is secured against a vertical bearing surface along a rearward end of said main body member of said die means and movable vertically along said vertical bearing surface during said adjustment step.

8. The improved tooling as set forth in claim 7 wherein said crimping plate is disposed in a vertical recess along said rearward end of said main body member and held in a vertical orientation thereby.

9. The improved tooling as set forth in claim 8 wherein said securing means is a tension means secured to said crimping plate forwardly thereof between said bearing surface and said crimping surface thereof and secured to said wedge member forwardly of said wedge bearing surface and thereby having a diagonal orientation and providing a horizontal force component urging said crimping plate against said vertical bearing surface of said main body member and a vertical force component urging said crimping plate against said wedge bearing surface.

10. The improved tooling as set forth in claim 9 wherein said tension means is a tension spring.

11. The improved tooling as set forth in claim 10 wherein said tension spring is disposed along a spring channel means of said main body member.

12. The improved tooling as set forth in claim 3 wherein said securing means is a tension mans secured to said crimping plate and forwardly thereof and secured to said wedge member forwardly of said plate-moving means having a diagonal orientation and providing a horizontal force component urging said crimping plate against a vertical bearing surface of said main body member and a vertical force component urging said crimping plate against said plate-moving means.

13. The improved tooling as set forth in claim 12 wherein said tension means is a tension spring.

14. The improved tooling as set forth in claim 3 further including a biasing means urging said crimping plate forwardly against a vertical bearing surface along a rearward end of said main body member and urging said crimping plate against said plate-moving means.

15. The improved tooling as set forth in claim 14 wherein said biasing means is a compression spring.

16. The improved tooling as set forth in claim 14 wherein said plate-moving means comprises a bearing surface on a wedge member having a preselected angle from the horizontal, and said crimping plate has a bearing surface remote from said crimping surface thereof and disposed against said wedge bearing surface and having a preselected angle from the horizontal such that said crimping plate is vertical with respect to said die means.

17. The improved tooling as set forth in claim 16 wherein said wedge bearing surface inclines towards the rearward end of said wedge member, and said upper bearing surface of said crimping plate correspondingly inclines.

18. The improved tooling as set forth in claim 1 capable of being secured in a handtool for applying a said connector to said conductors.

19. The improved tooling as set forth in claim 1 capable of being secured in a pneumatic bench machine for applying a said connector to said conductors.

20. The improved tooling as set forth in claim 1 capable of being secured in a semiautomatic apparatus for applying a said connector to said conductors.

21. A tool for electrically connecting electrical contacts of an electrical connector with insulated electrical conductors of an electrical cable, comprising:.

a base plate having a connector-receiving area in which the electrical connector is received and means for maintaining the electrical connector in position thereon;

die subassembly means including body means and contact-applying means for engaging the electrical contacts and moving them into electrical connection with the electrical conductors, said contact-applying means being movable with respect to said body means;

means mounting said die subassembly means and said base plate together so that said die subassembly means and said base plate are movable relatively toward and away from each other and means maintaining said die subassembly means in a normally inoperative position with the die subassembly means spaced from said base plate to enable the connector to be positioned in the connector-receiving area and to return the die subassembly means to the normally inoperative position after the die subassembly means has been operated;

means on said die subassembly means for securing said contact applying means thereto such that said contact applying means is controllably movable in the vertical direction with respect to said die subassembly means during an adjustment step while remaining secured thereto by said securing means;

means on said die subassembly means for adjusting the position of the contact-applying means relative to the base plate through a range of adjustment positions to achieve a preselected distance from said contacts of a contact-engaging surface of said contact-applying means; and stop means securing said contact-applying means against relative vertical movement with respect to said body means after said adjusting thereof.

22. A tool as set forth in claim 21 wherein said adjusting means includes a member controllably movable by an operator-accessible adjustment means along a forward-rearward horizontal axis with respect to said body means during an adjustment step, and a plate-moving means disposed on a rearward portion of said member engaging a contact-remote portion of said contact-applying means and capable of controllably moving said contact-applying means in a vertical direction with respect to said body means during said adjustment step.

23. A tool as set forth in claim 22 wherein said securing means secures said contact applying means to said member under tension, said securing means affixed to said member forwardly of said plate-moving means and affixed to said contact-applying means between said contact-engaging surface and said contact-remote portion, and having a diagonal orientation holding said contact-applying means against said plate-moving means and against a rear surface of said body means.

* * * * *